United States Patent [19]

Cirino

[11] 4,033,604

[45] July 5, 1977

[54] RELEASE ASSEMBLY FOR SKI BINDING

[76] Inventor: John F. Cirino, 40 Allen Farm Lane, Concord, Mass. 01742

[22] Filed: Aug. 21, 1975

[21] Appl. No.: 606,665

[52] U.S. Cl. ..... 280/628

[51] Int. Cl.[2] ..... A63C 9/08

[58] Field of Search ..... 280/11.35 T, 628, 634, 280/626

[56] References Cited

UNITED STATES PATENTS

| | | | |
|---|---|---|---|
| 3,614,118 | 10/1971 | Salomon | 280/628 |
| 3,831,957 | 8/1974 | Ramillon | 280/11.35 T |
| 3,865,390 | 2/1975 | Pradillon | 280/11.35 T |
| 3,866,929 | 2/1975 | Larcroix | 280/11.35 T |
| 3,892,422 | 7/1975 | Jaques | 280/11.35 T |

*Primary Examiner*—Robert R. Song

*Attorney, Agent, or Firm*—Kenneth R. Glaser

[57] ABSTRACT

Disclosed is a ski binding release assembly for releasably clamping the toe or heel of a boot with a ski, the extent of pressure necessary to effect lateral release of the boot and ski provided by a plate and coupled shaft rotatably mounted with the assembly housing and rod and spring assembly for adjusting pressure against the shaft; the extent of pressure necessary to effect upward release of the boot and ski provided by adjustable spring pressure against rollers resiliently urged into engagement with a pivotally mounted clamp support body. Slidable coupling between the release assembly housing and the mounting plate affixed to the ski enables limited longitudinal movement between the ski and release assembly.

13 Claims, 8 Drawing Figures

RELEASE ASSEMBLY FOR SKI BINDING

This invention pertains to ski bindings, more particularly to improved ski bindings releasable in both the upward and lateral directions, and even more particularly to improved toe and heel release assemblies for such ski bindings.

The past decade has witnessed an extraordinary increase in the popularity of, and interest in, snow skiing as a sport. This has resulted in not only increased numbers of professional skiers, but a proliferation of the amateur or "weekend" skier. As a consequence, it has become necessary that ski bindings be available which effectively meet the requirements of not only the professional skier, but also are effective to be compatible with the amateur's needs. For example, the needs of the latter class of skiers require a binding which is relatively inexpensive to produce, convenient to mount and operate, and which will effectively and reliably release under conditions which could cause injury. On the other hand, the more expert and professional skier performs intricate and sophisticated maneuvers, and it is important that the ski bindings not prematurely release during such maneuvers. Various types of ski bindings have been designed in an attempt to meet the aforementioned objectives, but to date have not been entirely satisfactory for all conditions of service.

It is therefore a principal object of the present invention to provide a new and improved ski binding.

It is another object of the invention to provide a ski binding which is generally inexpensive to produce, convenient to mount and operate, and which is effective to automatically, but not prematurely, release.

It is a still further object of the invention to provide new and improved toe or heel release assemblies which effectively and positively releases from the ski boot in both the lateral and upward direction in response to an excessive twisting motion of the skier.

In accordance with these and other objects, the present invention is directed to an improved ski binding having a release assembly, suitable for clamping either the ski boot heel or toe with the ski, which not only laterally releases the boot from the ski, but additionally allows for the upward release of the boot in response to excessive downward or twisting motion. As subsequently described in greater detail, the release assembly includes new and unique means for adjusting the amount of pressure required to release the heel in either the lateral or upward direction, thus preventing the premature release thereof.

Additional features, as well as other objects and advantages, of the present invention will become more readily apparent from the following detailed description taken in conjunction with the accompanying drawings wherein.

Figure 1:
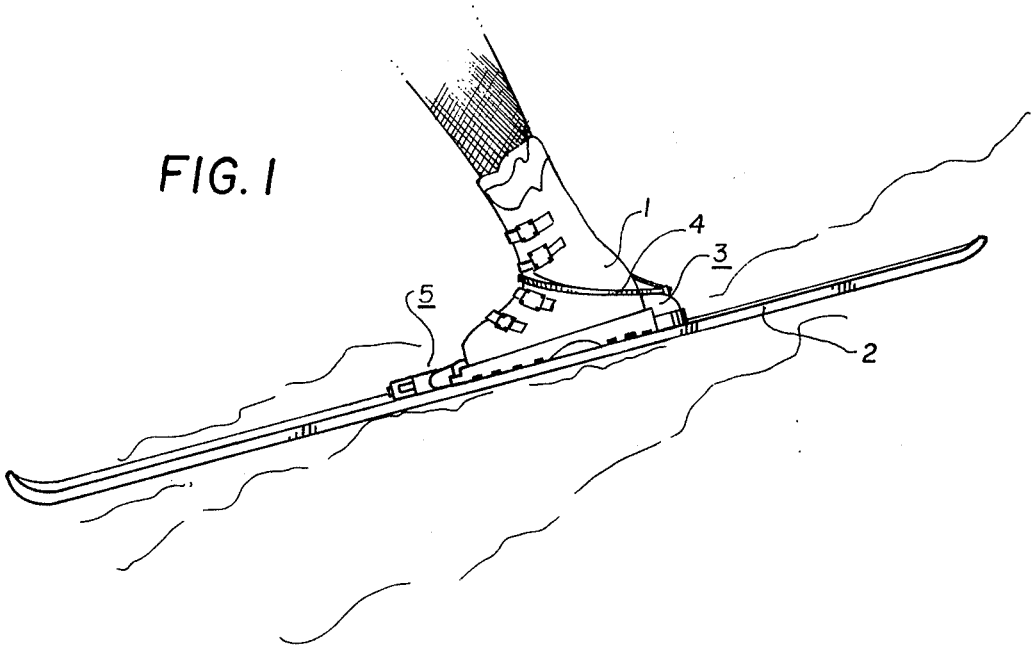
FIG. 1 is a diagrammatic representation of the use of the release assembly of the present invention for releasably clamping the toe of the ski boot.

Referring initially to FIG. 1, a ski boot 1 is releasably secured to a snow ski 2 by a ski binding comprising, in this embodiment, the release assembly 5 of the present invention adjustably and releasably clamping the toe or front of the ski boot to the ski and a conventional heel clamp assembly 3 for gripping the rear of the ski boot. As is conventional, a safety strap 4 may be provided to retain the ski with the boot upon release of the toe assembly. Since the heel assembly is conventional and does not form a part of the invention; and since the release assembly 5, in this first embodiment, is adapted to releasably uncouple the ski and the toe of the boot, the heel assembly may be of either the release or non-release type.

Figure 2:
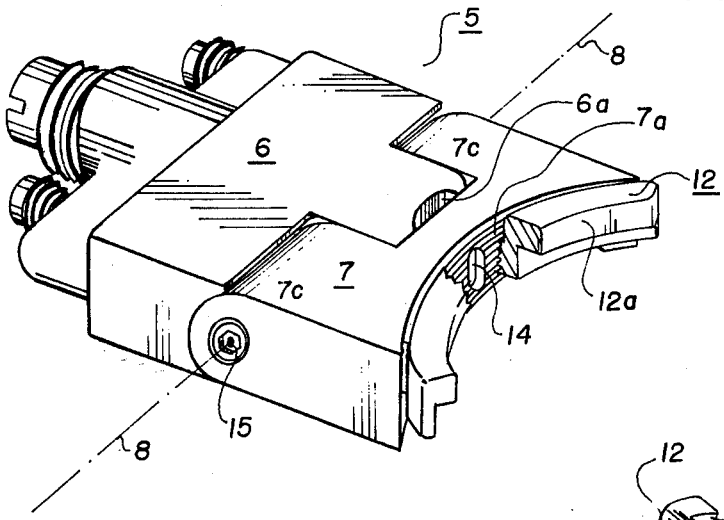
FIG. 2 is a pictorial view of the top of the release assembly illustrating the pivotally mounted clamp in its downward or "clamped" position.
Figure 3:
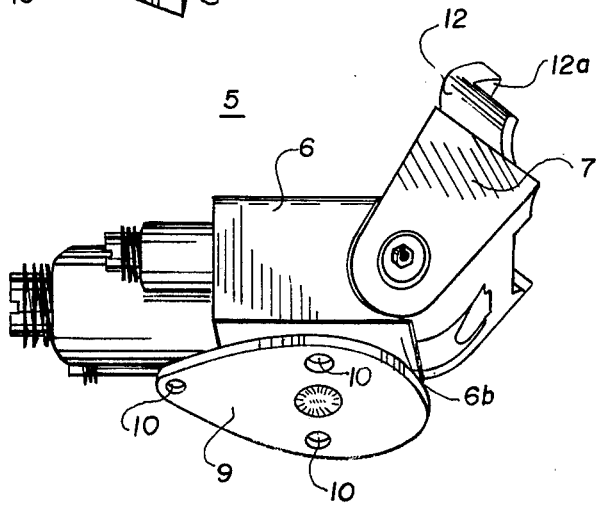
FIG. 3 is a pictorial view from the side of the release assembly depicted in FIG. 2 showing the clamp portion in its upward or "released" position.
Figure 4:
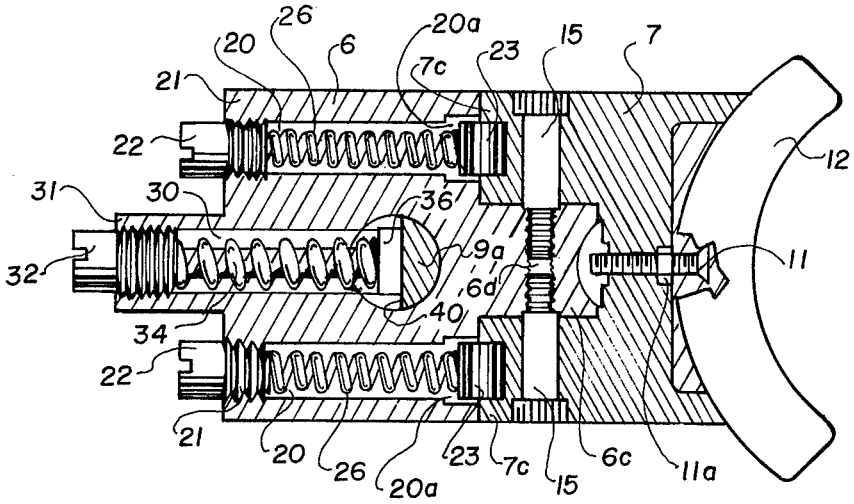
FIG. 4 is a partial sectional top view of the release assembly.

Referring to FIGS. 2–4, the release assembly 5 includes a main housing 6 and a clamp support body 7. A central extension 6*c* of the main housing is positioned between extending end portion 7*c* of the clamp support body; and a pair of pins 15 having externally threaded ends respectively extend through openings in portions 7*c* into a mutually aligned internally threaded opening 6*d* in the central extention 6*c*. Thus, the support body 7 is mounted to pivot with respect to the main housing around an axis 8 between a "clamped" position (depicted in FIG. 2) and a "release" position (depicted in FIG. 3).

A mounting plate 9 is pivotally coupled to the main housing 6 by the way of an integrally joined shaft 9*a* (FIG. 5) passing through a vertically extending opening in the base 6*b* of the housing 6. A plurality of openings 10 enable the plate 9 to be rigidly secured to the ski by way of suitable fasteners passing through these openings. Thus, the release assembly 5, and particularly the main housing portion thereof, is not only secured to the ski; but is adapted to rotate around the shaft 9*a* to and from longitudinal alignment with, and in a plane generally parallel to, the top surface of the ski. As subsequently described in greater detail, means are provided in operative relation with the shaft 9*a* to limit the degree of, as well as to determine the amount of pressure necessary to effect, such rotation.

Connected to the support body 7, for example, by way of a threaded bolt and nut assembly 11 and 11*a* (FIG. 4), is an arcuate shaped clamp 12 having a flanged extension 12*a* for engaging (in this example) the top surface of the sole of the ski boot. The clamp support body 7 has a concave face 7*a* with a contour conforming to the convex surface of the clamp 12, the face 7*a* additonally including a vertical slot 14 adapted to receive the threaded bolt 11. In this manner, the clamp 12 can be vertically adjusted to accommodate the various size ski boots, a recess 6*a* being provided in the end of the central extension 6*c* to allow for the vertical translation of the bolt 11. To aid in the secure coupling of the support body 7 and the clamp 12, the mutually engaging surfaces of the support body and the clamp may be suitably ribbed (as shown in FIG. 2), thus assuring a stronger bond therebetween.

Figure 6:
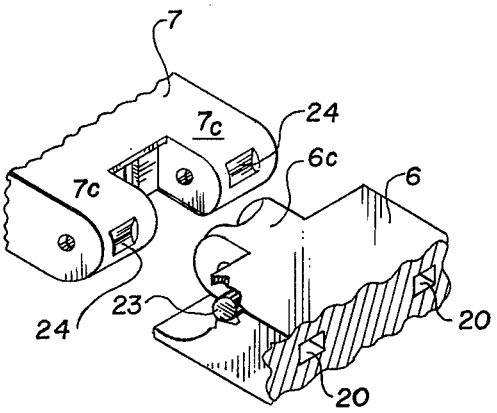
FIG. 6 illustrates the interrelationship between the main housing and the clamp support body, particularly depicting the mechanism for adjusting the pressure for upward release of the release assembly.

Referring now to FIGS. 4 and 6, the mechanism for adjusting the extent of pressure required to upwardly pivot the clamp support body 7 from clamping engagement with the toe of the ski boot (release position shown in FIG. 3) is now described. Accordingly, a pair of channels 20 longitudinally extend through the housing 6 between openings centrally defined at the end walls 21 of the main housing and enlarged openings 20*a* at the intersection of the main housing and the extensions 7*c* of the toe clamp support body 7. The portion of each of the channels 20 immediately adjacent the end walls 21 are internally threaded to receive externally threaded ends of adjustment screws 22. Recesses 24 are respectively disposed in the end faces of extension 7*c* and are mutually aligned with the enlarged openings 20*a*.

Respectively disposed within each of the enlarged openings 20*a* are a pair of pressure cylinders 23 adapted to be urged into, and therefore dimensioned to fit within the confines of, the recesses 24. A pair of springs 26 are respectively disposed within the channels 20 and have opposed end portions abutting against the adjustment screws 22 and the pressure cylinders 23. The advancement of each of the adjustment screws 22 into the channel 20 will resiliently urge the cylinders out of openings 20*a* into the recesses 24; and the extent of such advancement will thereby determine the resultant pressure exerted against the recessed faces of the clamp support body 7. Thus, the threadable advancement and retraction of screws 22 determines the extent of the counter-pressure required from the skier to upwardly release the clamp from the toe of the ski boot. In the illustration of FIG. 4, the adjustment screws 22 have been advanced to their furthermost position within the channels 20, thus maximizing the counter-pressure necessary to effect this upward release.

Figure 5:
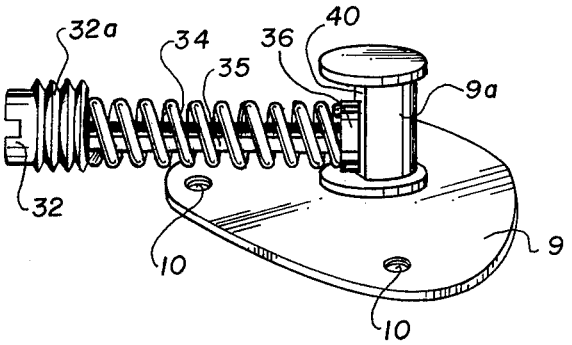
FIG. 5 is a pictorial view illustrating the mechanism for adjusting the pressure for lateral release of the release assembly.

Referring now to FIGS. 4 and 5, the mechanism for adjusting the extent of pressure required to enable the lateral rotation of the entire release assembly 5 (thus laterally releasing the boot from the ski) is now described. Accordingly, the main housing 6 also includes a channel 30 longitudinally extending between a centrally defined opening in the end wall 31 of the main housing and an opening in communication with the vertically extending opening of the main housing 6 through which the mounting plate shaft 9*a* extends. The portion of the channel 30 adjacent the end wall 31 is internally threaded and is therefore adapted to receive the externally threaded portion of an adjustment screw 32.

Disposed within the channel 30, and surrounded by a spring 34, is a rod 35 having an integrally joined circular disc 36 at one end thereof. One end of the spring 35 abuts against the face of the adjustment screw 32, while the other end is adapted to resiliently urge the disc 36 against a flat face 40 of the shaft 9*a*. Thus, advancement of the adjustment screw 32 into the channel 30 will result in the disc 36 being resiliently pressured against the flat face 40 of the shaft 9*a*, an internal channel 32*a* in the adjustment screw 32 enabling its advancement past the end of the rod 35. The extent of such advancement will thereby determine the amount of counter-pressure necessary to pivotally rotate the assembly 5 in the plane of the ski, thus determining the extent of counter-pressure from the skier necessary to effect lateral release of the boot from the ski. In the illustration of FIG. 4, the adjustment screw 32 has been fully advanced into the channel 30, thus maximizing the extent of pressure necessary to effect this lateral release. Additionally, the flat face 40 limits the extent of counter-clockwise or clockwise rotation of the assembly 5.

The installation and operation of the release assembly 5 of the present invention, and particularly as a toe release assembly, is now described. Accordingly, the entire assembly is mounted to the ski by the way of the mounting plate 9; and the screws 22 and 23 are adjusted in accordance with the upward and lateral release pressures desired by the skier. The bolt and nut assemblies 11 and 11*a* are initially released and then tightened to vertically position the clamp 12 on the toe of the boot; and the clamp support body 7 is forced to the "clamped" position depicted in FIGS. 1 and 2. Thereafter, if the skier encounters either premature or delayed lateral or upward release, the adjustment screws 32 or 22 can be appropriately adjusted.

As an alternative embodiment to that just described, the release assembly 5 may be employed for releasably retaining the heel portion of the boot 1 with ski 2. When so used, the toe release assembly portion of the overall ski binding may be of conventional construction or, alternatively, may also have the construction and operation of the release assembly of the present invention.

Figure 7:
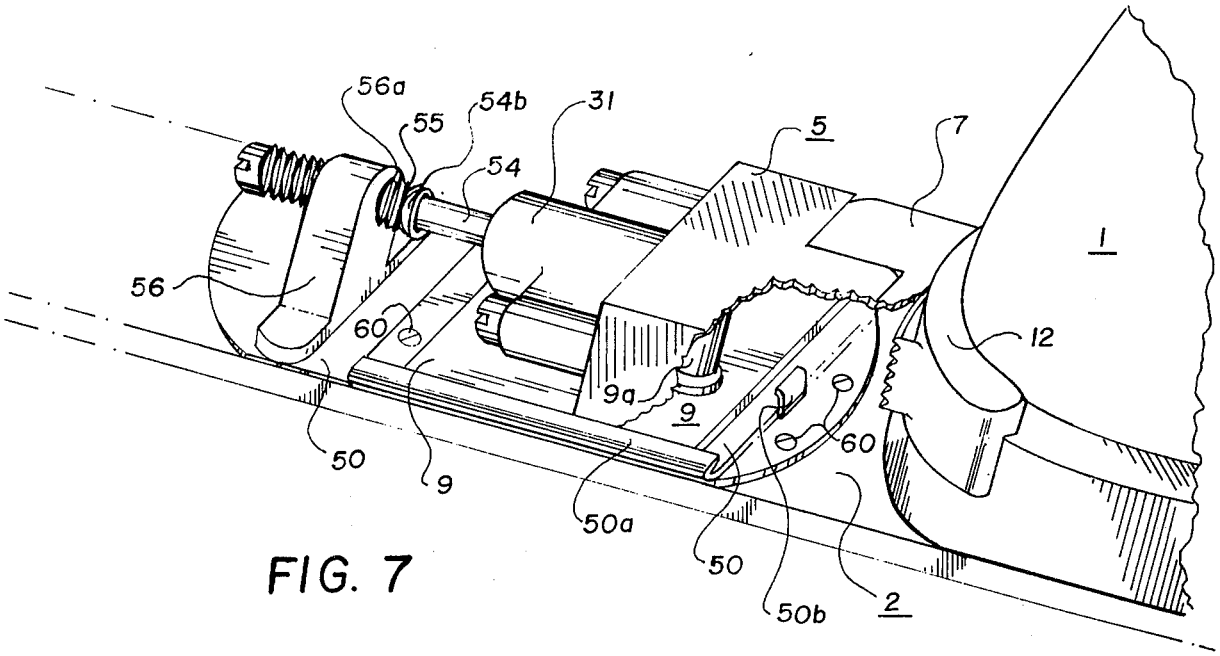
FIGS. 7 and 7A depict a modification of the release assembly of the present invention, illustrating its use for releasably clamping the heel of the ski boot.

As is apparent from FIG. 7, when the release assembly 5 is employed as a heel release assembly, the pivotally movable clamp support body 7 (and particularly the clamp portion 12) is adapted to releasably clamp the heel portion of the boot 1 in substantially the same manner as that previously described with respect to the releasable clamping of the toe of the boot.

In addition, however, and in accordance with a further modification of the previously described construction of the assembly 5, the plate 9, rather than being mounted directly to the ski 1, is of a size and shape (preferably rectangular) adapted to be slidably received within a separate mounting plate 50. The plate 50 is rigidly secured to the ski 2 by fasteners 60 and includes a pair of opposed tabs 50*a* for slidably gripping the top surface of the plate 9 and a curved projection 50*b* for limiting the extent of forward movement of plate 9.

Figure 7A:
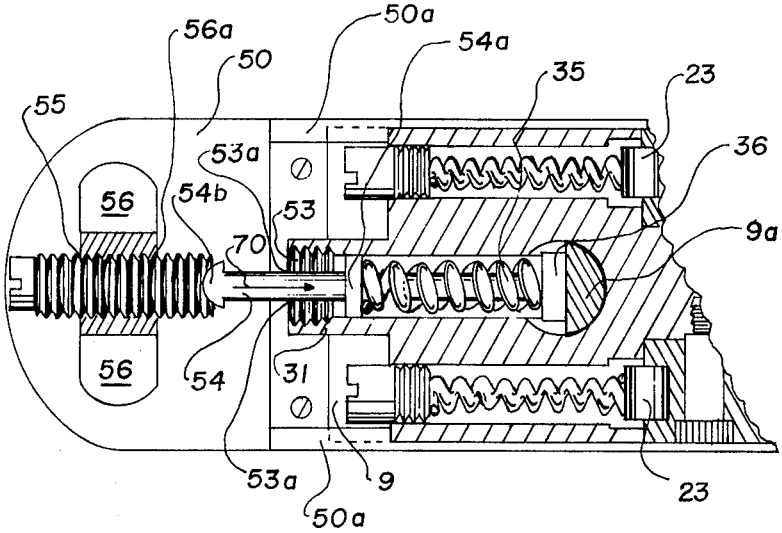

As best depicted in FIG. 7A, a collar 53 having a centrally defined opening 53*a* is threadably secured within the end wall portion 31. Longitudinally extending through the opening 53*a*, and mounted for translatable movement therein, is a cylindrical rod 54 having an integrally joined disc 54*a* at a forward end thereof. The rear face of the disc 54*a* is adapted to engage a forward wall of the collar 53, the spring 35 engaging the forward face of disc 54*a*. Thus, as is apparent, the translation of the rod 54 in the direction of arrow 70 compresses the spring 35, thereby resiliently urging disc 36 against shaft 9*a* in a manner similar to that previously described.

The rod 54 furthermore has an enlarged end portion 54*b* of a size and shape to be received within the forwardly disposed concave face of a plug 55. The plug 55 is threadably, and therefore adjustably, mounted within a longitudinally extending opening 56*a* in support means 56 disposed at the rear of mounting plate 50. The opening 56*a* and adjustable plug 55 are axially aligned with rod 54 so that the threadable adjustment of the plug 55 within the support 56 determines the extent of compression of the spring 35, thus establishing the extent of counter-pressure necessary to pivotally rotate the assembly 5 to effect lateral release of the heel of the boot from the ski in the manner previously described. Furthermore, in the event that the boot is subjected to an initial severe rearward thrust or the ski itself experiences unusual flexing, the entire release assembly 5 is free to initially slide rearwardly, the spring 35 thereafter returning the assembly to its original position.

Thus, the modification depicted in FIGS. 7 and 7A not only provides for the adjustable lateral (and upward) release of the heel; but, due to the slidable coupling between plate 9 and mounting plate 50, additionally provides a limited degree of flexibility of longitudinal movement of the entire release assembly 5 with respect to the ski, thus preventing the assembly from being torn loose from its mounting in the event of severe flex of the ski. While such modification has particular advantages when the release assembly is employed as a heel release assembly, it can also be employed to releasably engage the toe.

Thus, it can be readily appreciated that the release assembly of the present invention affords an effective, quick upward release in response to excessive twist of the foot, as well as an effective, more gradual, release in the lateral direction. Furthermore, the assembly is inexpensive to produce, convenient to mount and operate, and can be suitably adjusted to avoid premature release of the boot and ski. If desired, means may be provided on the clamp support body 7 for receiving a handle in order to allow the manual pivoting of the clamp support body to facilitate the insertion and removal of the boots in the bindings.

Various modifications of the disclosed embodiments, as well as additional embodiments, may become apparent to those skilled in the art after reviewing the foregoing description without department from the spirit and scope of the invention as defined by the following claims:

What is claimed is:

1. In ski binding apparatus of the type for releasably securing a boot and ski, a release assembly comprising:

a. a main housing mounted with said ski to rotate about a vertical axis between a first position in longitudinal alignment with said ski and a second position out of such longitudinal alignment, said main housing being pivotally coupled to vertically extending shaft means rigidly secured to said ski, b. clamp support body means mounted with said main housing to respectively pivot about a horizontal axis toward and away from clamping engagement with said boot, c. first means for applying a controlled amount of pressure to said main housing to determine the ease by which said main housing can rotate between said first and second position, said first means comprising pressure plate means resiliently urged against said shaft means and first adjustment means for adjusting the extent of resilient pressure of said pressure plate means against said shaft means, d. second means for applying a controlled amount of pressure against said clamp support body means, thereby to determine the ease by which said clamp support body means can pivot toward and away from said clamping engagement, said second means comprising pressure cylinder means resiliently urged against said clamp support body means at the locus of pivotal intersection of said support body and said main housing, and second adjustment means for adjusting the extent of resilient pressure by which said pressure cylinder means is urged against said clamp support body, and e. clamp means secured to said clamp support body for engaging said boot, f. said main housing including a pair of channels longitudinally extending between opposed end walls of said main housing and terminating in enlarged openings at said locus of pivotal intersection, g. said second means comprising a pair of cylindrical rollers respectively disposed within said enlarged openings, a pair of springs respectively disposed within said channels for urging said rollers into engagement with said clamp support body, and adjustment screws threadably received within said channels at one of said opposed end walls for determining the extent said springs urge said rollers against said clamp support body.

2. The release assembly as defined by claim 1 wherein said cylindrical rollers are received within recessed portions of said clamp support body at the said locus of pivotal intersection.

3. The release assembly as defined by claim 1 wherein said clamp means is positioned to engage the toe portion of said boot.

4. The release assembly as defined by claim 1 wherein said clamp means is positioned to engage the heel portion of said boot.

5. The release assembly as defined by claim 1 wherein said main housing is additionally mounted to slide with respect to, and in the longitudinal direction of, said ski.

6. The release assembly as defined by claim 5 further comprising first plate means rigidly secured to said ski and second plate means slidably received by said first plate means; said first adjustment means being coupled between said first plate means and said second plate means.

7. In ski binding apparatus of the type for releasably securing a boot and ski, a release assembly comprising:

a. a main housing pivotally mounted with said ski to rotate between a first position in longitudinal alignment with said ski and a second position out of such longitudinal alignment, said main housing including a pair of channels longitudinally extending between opposed end walls of said main housing, b. clamp support body means mounted with said main housing to respectively pivot about a horizontal axis toward and away from clamping engagement with said boot, said clamp support body means having a pair of recessed portions respectively mutually aligned with said pair of channels, c. means for applying a controlled amount of pressure against said clamp support body means, thereby to determine the ease by which said clamp support body means can pivot toward and away from said clamping engagement, said pressure applying means comprising a pair of cylindrical rollers respectively disposed within said pair of channels at one of said opposed end walls, a pair of springs respectively disposed within said channels for urging said rollers into engagement with said recessed portions of, and against, said clamp support body, and adjustment screws threadably received within said channels at the other one of said opposed end walls for determining the extent said springs urge said rollers against said clamp support body, and d. clamp means secured to said clamp support body for engaging a portion of said boot.

8. The assembly as defined by claim 7 wherein said clamp means is vertically adjustable with respect to said clamp support body.

9. The assembly as defined by claim 8 wherein said clamp means is positioned to engage the toe portion of said boot.

10. The assembly as defined by claim 8 wherein said clamp means is positioned to engage the heel portion of said boot.

11. The release assembly as defined by claim 7 wherein said main housing is additionally mounted to slide with respect to, and in the longitudinal direction of, said ski.

12. The release assembly as defined by claim 11 further comprising first plate means rigidly secured to said ski, second plate means slidably received by said first plate means, and means coupled between said first and second plate means for applying pressure to said main housing, thereby controlling the ease by which said main housing can rotate between said first and second position.

13. In ski binding apparatus of the type for releasably securing a boot and ski, a release assembly comprising:

a. a main housing pivotally mounted with said ski to rotate between a first position in longitudinal alignment with said ski and a second position out of such longitudinal alignment, said main housing including a pair of channels longitudinally extending between opposed end walls of said main housing, b. clamp support body means mounted with said main housing to respectively pivot toward and away from clamping engagement with said boot, said clamp support body means having a pair of recessed portions respectively mutually aligned with said pair of channels, said clamp support body pivoting about a horizontal axis, c. means for applying a controlled amount of pressure against said clamp support body means, thereby to determine the ease by which said clamp support body means can pivot toward and away from said clamping engagement, said pressure applying means comprising a pair of detents respectively disposed within said pair of channels at one of said opposed end walls, a pair of springs respectively disposed within said channels for urging said detents into engagement with said recessed portions of, and against, said clamp support body, and adjustment screws threadably received within said channels at the other one of said opposed end walls for determining the extent said springs urge said detents against said clamp support body, and d. clamp means secured to said clamp support body for engaging a portion of said boot.

* * * * *

UNITED STATES PATENT OFFICE

CERTIFICATE OF CORRECTION

Patent No. 4,033,604 Dated July 5, 1977

Inventor(s) John F. Cirino

It is certified that error appears in the above-identified patent and that said Letters Patent are hereby corrected as shown below:

Claim 2 should be:

2. The release assembly as defined by Claim 1 wherein said clamp support body includes recessed portions at said locus of pivotal intersection and cylindrical rollers are urged into engagement with said recessed portions.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*